United States Patent [19]

Karasawa

[11] 4,298,919

[45] Nov. 3, 1981

[54] LAMP HOUSE STRUCTURE FOR ILLUMINATION DEVICES

[75] Inventor: Yukinori Karasawa, Tokyo, Japan

[73] Assignee: Tokyo Kogaku Kikai Kabushiki Kaisha, Tokyo, Japan

[21] Appl. No.: 72,693

[22] Filed: Sep. 5, 1979

[30] Foreign Application Priority Data

Sep. 11, 1978 [JP] Japan ..... 53-124445[U]

[51] Int. Cl.[3] ..... H01R 33/00; F21V 25/00

[52] U.S. Cl. ..... 362/226; 362/365; 362/391; 362/430; 362/457; 362/804

[58] Field of Search ..... 362/226, 105, 310, 365, 362/391, 430, 457, 804

[56] References Cited

U.S. PATENT DOCUMENTS

| | | | |
|---|---|---|---|
| 1,186,454 | 6/1916 | Toler | 362/310 X |
| 2,254,988 | 9/1941 | Adams | 362/226 |
| 2,550,234 | 4/1951 | Duncan | 362/310 X |
| 2,651,301 | 9/1953 | Allyn et al. | 362/804 X |
| 2,678,381 | 5/1954 | Schwartz | 362/365 |

*Primary Examiner*—Richard D. Lovering

*Attorney, Agent, or Firm*—Stevens, Davis, Miller & Mosher

[57] ABSTRACT

An illumination device has a lamp house comprising a body and a cap detachably attached to the body. A pair of electrically conductive jacks are provided for engagement with a connector element on a power supply cable. One of the jacks is carried on the body and the other on the cap whereby the cap cannot be removed from the body as long as the connector element is engaged with the jacks.

3 Claims, 3 Drawing Figures

LAMP HOUSE STRUCTURE FOR ILLUMINATION DEVICES

The present invention relates to lamp house structures for illumination devices.

In most optical instruments for medical use, there are provided illumination devices including illumination lamps which are disposed in lamp houses. In conventional lamp house structures, caps are provided for enabling removal and installation of the lamps. Thus when it is desired to replace the illumination lamp, the cap is first removed to provide an access to the lamp. However, the conventional structures have been such that the replacement of lamp can be done even without cutting the power supply to the lamp. Therefore, there has been a danger of electric shock during the lamp replacement operation when such work is carried out without cutting the power supply.

It is therefore an object of the present invention to provide a lamp house structure for an illumination device in which the cap of the lamp house cannot be removed without disconnecting the electric power supply cable.

According to the present invention, the above and other objects can be accomplished by a lamp house for an illuminating device, which comprises a body, a cap which is adapted to be detachably attached to the body, means for mounting at least one illumination lamp, at least a pair of electrically conductive jacks respectively connected with said lamp and adapted to be engaged with a connector element for power supply cable, one of said jacks being mounted on said body and the other on said cap whereby removal of said cap is prevented when the jacks are engaged with said connector element. One of the body and the cap may be formed with a wall which is adapted to encircle said jacks to define a receptacle of an electric connector assembly when the cap is attached to the body. In that case, the wall may be formed with a cut-off for passing one of the jacks when the cap is being attached to the body.

The above and other objects and features of the present invention will become apparent from the following descriptions of a preferred embodiment taking reference to the accompanying drawings, in which.

Figure 1:
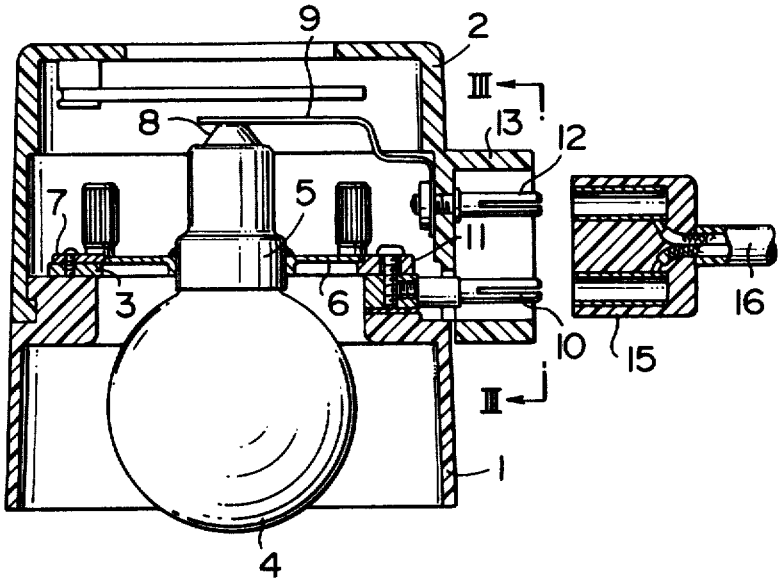
FIG. 1 is a vertical sectional view of the lamp house in accordance with one embodiment of the present invention.
Figure 2:
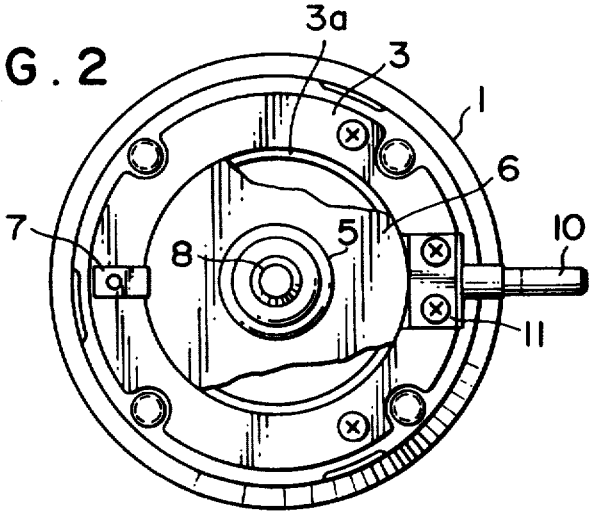
FIG. 2 is a partially cut-away plan view of the body of the lamp house.
Figure 3:
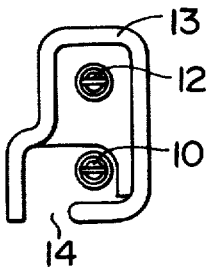
FIG. 3 is a view as seen in the direction of the arrow III—III in FIG. 1.

Referring now to the drawings, particularly to FIG. 1, the lamp house shown therein includes a body 1 and a cap 2 which is detachably attached to the body 1 by means for example of screw threads. On one end of the body 1, there is mounted a ring 3 which is adapted for mounting a lamp 4. As shown in FIG. 2, the ring 3 is formed at the upper side of the inner periphery with a step 3*a*. The lamp 4 includes a base 5 having an electrically conductive flange 6 which is welded thereto. The flange 6 of the lamp 4 is fitted to the step 3*a* of the ring 3 for mounting the lamp. The ring 3 is provided with a locating key 7 and the flange 6 of the lamp 4 has a cut-out for engagement with the key 7. The cap 2 is provided with a resilient contact arm 9 in the form of a leaf spring which is adapted to engage with an eyelet contact 8 of the lamp 4. Thus, the lamp 4 is held in position between the ring 3 and the contact arm 9.

The body 1 is provided at the side opposite to the key 7 with an electrically conductive jack 10 which is in electric contact with the flange 6 of the lamp 4 through a conductive piece 11 secured to the flange 6. The cap 2 has an electrically conductive jack 12 which is secured thereto and adapted to be located directly above the jack 10 when the cap 2 is attached to the body 1. The jack 12 is in electric contact with the contact arm 9. The jacks 10 and 12 are adapted to be engaged with a connector element 15 provided at one end of an electric power supply cable 16. It should therefore be noted that the cap 2 cannot be removed from the body 1 as long as the connector element 15 is engaged with the jacks 10 and 12. Thus, in order to relace the lamp 4, it is necessary to disconnect the connector element 15 from the jacks 10 and 12.

In the illustrated arrangement, there is provided a wall 13 encircling the jacks 10 and 12 for protecting the jacks when the connector element 15 is not engaged with them. The wall 13 has a cut-out 14 at the lower side for passing the jack 10 when the cap 2 is being mounted on the body 1.

The invention has thus been shown and described with reference to a specific embodiment, however, it should be noted that the invention is in no way limited to the details of the illustrated structures but changes and modifications may be made without departing from the scope of the appended claims.

I claim:

1. A lamp house for an illuminating device, which comprises a body, a cap which is adapted to be detachable attached to the body, means for mounting at least one illumination lamp, at least a pair of electrically conductive jacks respectively connected with said lamp and adapted to be mechanically and electrically engaged with a connector element for a power supply cable, one of said jacks being securely mounted on said body and the other being securely mounted on said cap such that removal of said cap from said body is prevented when the jacks are engaged with said connector element.

2. A lamp house in accordance with claim 1 in which one of the body and the cap is formed with a wall which is adapted to encircle said jacks to define a receptacle of an electric connector assembly when the cap is attached to the body.

3. A lamp house in accordance with claim 2 in which the wall is formed with a cut-off for passing one of the jacks when the cap is being attached to the body.

* * * * *